United States Patent [19]

Velazquez

[11] 4,213,610

[45] Jul. 22, 1980

[54] TOY BASEBALL GAME

[76] Inventor: Jacinto Velazquez, 1257 Loring Ave., Brooklyn, N.Y. 11208

[21] Appl. No.: 898,039

[22] Filed: Apr. 20, 1978

[51] Int. Cl.[2] ..... A63F 7/02; A63F 7/06

[52] U.S. Cl. ..... 273/93 R; 273/144 A

[58] Field of Search ..... 273/93 R, 144 R, 144 A, 273/144 B

[56] References Cited

U.S. PATENT DOCUMENTS

| | | | |
|---|---|---|---|
| D. 89,205 | 2/1933 | Nunn | 273/93 R UX |
| 1,150,014 | 8/1915 | Bourne | 273/93 R |
| 1,560,974 | 11/1925 | Clays | 273/144 A |
| 2,893,735 | 7/1959 | Tranter | 273/93 R X |

FOREIGN PATENT DOCUMENTS

| | | | |
|---|---|---|---|
| 1033153 | 4/1953 | France | 273/144 A |

*Primary Examiner*—Anton O. Oechsle

*Attorney, Agent, or Firm*—Howard I. Podell

[57] ABSTRACT

A toy baseball game having a diamond-shaped base with a plurality of pockets. A two-piece bat is mounted on the base with a bracket fixed to each piece and rotatably mounted on the bracket is a large simulated hollow baseball containing a number of smaller balls bearing indicia referring to baseball game happenings. The hollow ball has an ejector mechanism for propelling one ball at a time out of the lower part of the bat and onto pockets in the base, after the balls have been tumbled in the hollow baseball to introduce an element of chance in the game.

1 Claim, 3 Drawing Figures

TOY BASEBALL GAME

FIELD OF THE INVENTION

This invention relates generally to a toy baseball game.

DESCRIPTION OF THE PRIOR ART

The prior art, as exemplified by U.S. Pat. Nos. 1,808,802; 3,227,452; 2,829,895; 2,511,048; 3,355,173; 3,879,037 or 2,749,122 is generally illustrative of the pertinent art but the aforementioned patents are non-applicable to the present invention. While the prior art expedients are generally acceptable for their intended purposes only, they have not proven entirely satisfactory in that they are either complex and expensive to manufacture, or bulky and inconvenient to use, or require unusual skill and/or dexterity to operate. As a result of the shortcomings of the prior art, typified by the above, there has developed a substantial need for improvement in this field.

The principal object of this invention is to provide a device or article of this character which combines simplicity, strength and durability in a high degree, together with inexpensiveness of construction so as to encourage widespread use thereof.

Other objects of this invention will in part be obvious and in part hereinafter pointed out.

The invention accordingly consists in the features of construction, combinations of elements, and arrangement of parts which will be exemplified in the construction hereinafter described, and of which the scope of application will be indicated in the following claims.

SUMMARY OF THE INVENTION

This invention resides in a toy baseball game having a diamond-shaped base with a plurality of pockets. A two-piece bat is mounted on the base with a bracket fixed to each piece and rotatably mounted on the bracket is a large simulated hollow baseball containing a number of smaller balls bearing indicia referring to baseball game happenings. The hollow ball has an ejector mechanism for propelling one ball at a time out of the lower part of the bat and onto pockets in the base, after the balls have been tumbled in the hollow baseball to introduce an element of chance in the game.

BRIEF DESCRIPTION OF THE DRAWING

In the accompanying drawing, in which is shown one of the various possible illustrative embodiments of this invention, wherein like reference character identify the same or like parts.

DESCRIPTION OF THE PREFERRED EMBODIMENTS

Figure 1:
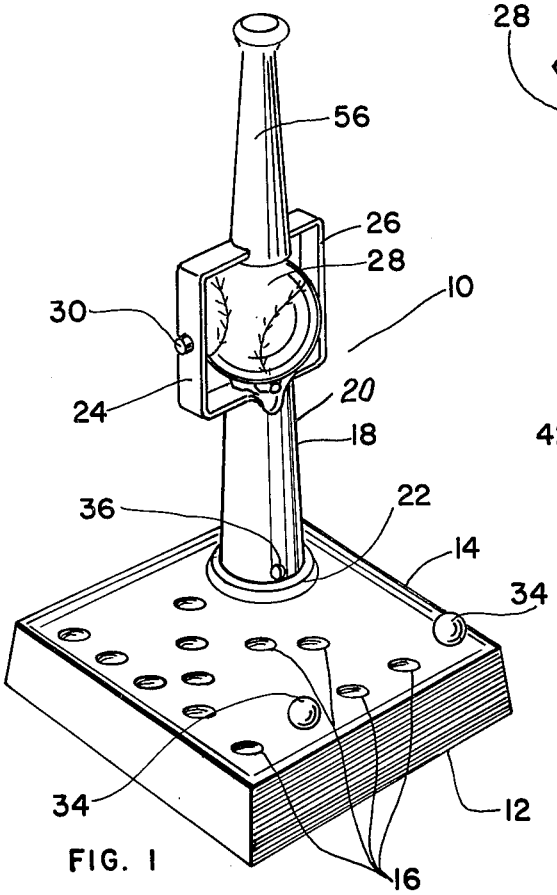
FIG. 1 is a view in perspective of the toy of this invention.

With reference to the drawing, there is shown and illustrated a toy baseball game constructed in accordance with the principles of the invention and designated generally by reference character 10. The illustrated tangible embodiment of the invention includes a generally rectangular base 12 of wood, plastic or metal surrounded by an upstanding wall or rim 14 provided with a plurality of randomly disposed pockets 16. Mounted in one corner of base 12 is the hollow lower half 18 of plastic simulated baseball bat 20 which is secured on base 12 by collar rim 22. Integral with the upper part of member 18 is the lower part 24 of rectangular bracket 26.

A large simulated hollow plastic baseball 28 is rotatably mounted by screws 30 to the vertical sides of bracket 26. Baseball 28 has a flanged opening 32 which is of a diameter sufficient to allow passage in and out of a plurality of smaller simulated plastic baseballs 34 which are adapted to be received in pockets 16 of the toy base 12 after passing through opening 36 in the bottom of member 18.

Fourteen balls 34 are provided which are labelled as follows:

Three marked "Out"
One marked "Strike One"
One marked "Two Outs"
One marked "Homerun"
One marked "Two Runs"
One marked "Three Runs"
One marked "Strike Three"
One marked "Third Base"
One marked "Three Outs"
One marked "First Base"
One marked "One Run"
One marked "Strike Two"

Figure 3:
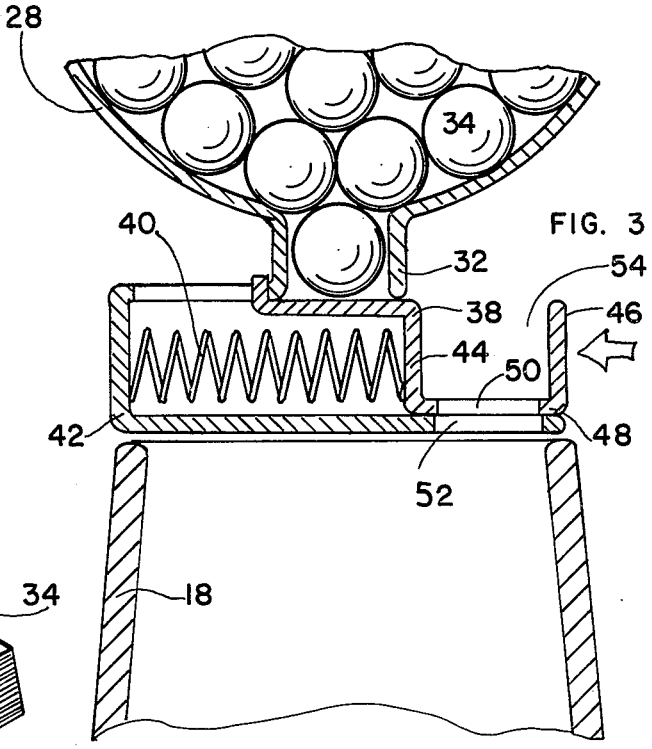
FIG. 3 is a cross-sectional view taken along line III—III of FIG. 2.
Figure 2:
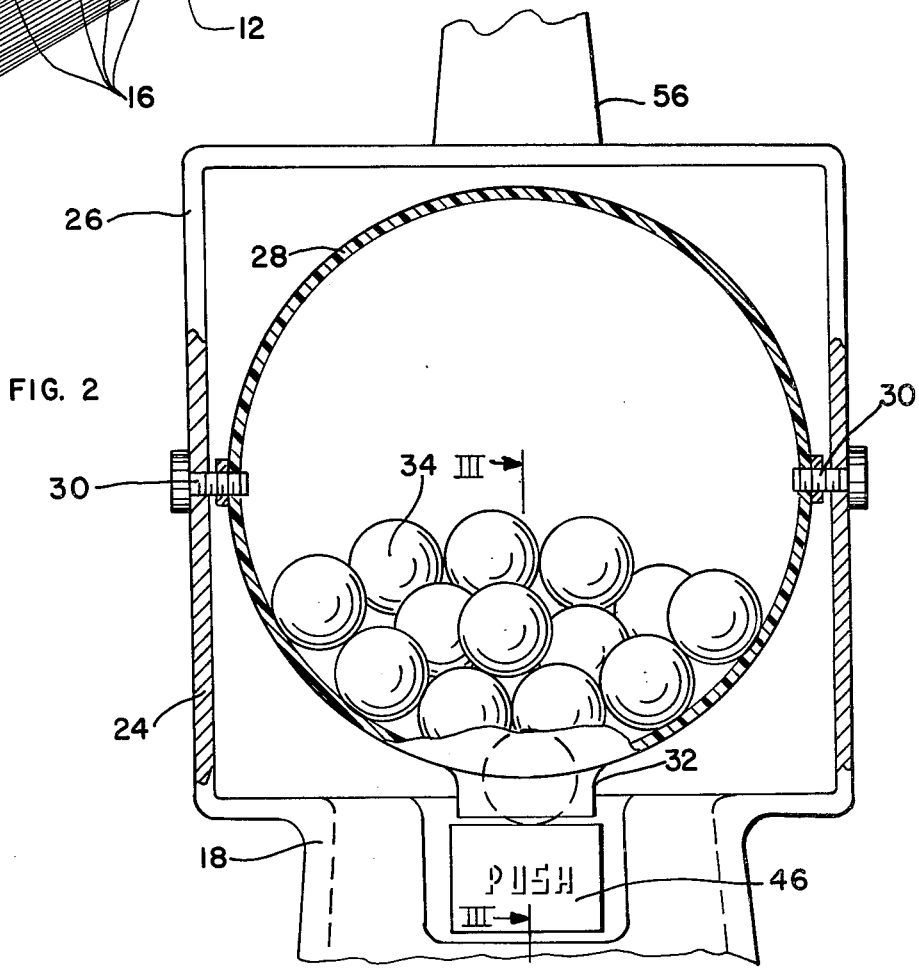
FIG. 2 is a sectional view of the simulated baseball and of its contents.

The opening 32 normally lies above the upper wall 38 which is biased into closed position, shown in FIG. 3 by an expansion spring 40 confined between walls 42 and 44. Pusher 46 is integral with wall 44 and joined by flat piece 48 which has a bottom opening 50 adapted to register with an identical opening 52 atop member 18.

As seen in FIG. 3, pushing pusher 46 causes one of the balls 34 to fall in pocket 54 between upstanding walls 44 and 46, and to then fall through openings 50 and 52 upon return of the ejector mechanism and into member 18 thence through opening 36 to eventually lodge in one of the pockets 16. If the ball 34 fails to stay in the pocket, it is replaced in ball 28 and the player is deemed to have lost a turn at bat.

As shown in FIG. 1, the handle 56 is fixed to the upper part of bracket 26.

In use, the toy is played using more or less the same rules as in baseball. Each player in turn shoots one ball after tumbling the balls 34 in ball 28 to introduce an element of chance in the game each player keeps score taking turns after each inning.

If desired, additional balls 34 associated with other game events (balks, errors, etc.) can be added.

The operation and use of the game hereinabove described will be evident to those skilled in the art to which it relates from a consideration of the foregoing.

The present invention is believed to accomplish among others all of the objects and advantages herein set forth.

Without further analysis, the foregoing will so fully reveal the gist of this game that those skilled in the art can by applying current knowledge thereto readily adapt it for various applications without omitting certain features which can constitute essential characteristics of the generic or specific aspects of this invention. Therefore, a more lengthy description is deemed unnecessary.

It is intended that various changes may be made in this invention in the practical development thereof, if desired. Such changes are comprehended within the meaning and range of equivalency of the following claims. The invention, therefore, is not to be restricted except as is necessitated by the prior art.

Having thus described the invention, what is claimed as new and to be secured by Letters Patent is:

1. In a toy baseball game, an open base including a plurality of pockets recessed from the upper surface of the base, a batting device comprising an upright hollow post fixed on said base to extend above said base and having an opening in the lower part thereof; said post having an aperture adjacent its upper end; a ball ejecting mechanism communicating with said aperture mounted to said post, a bracket secured to said upper end; a simulated hollow baseball rotatably mounted on said bracket and containing a plurality of smaller, simulated baseballs bearing indicia referring to baseball game occurrences; said hollow baseball having an opening of a size sufficient to allow successive passage of said smaller baseballs therethrough; said opening being rotatable to a first position above said ball ejecting mechanism for delivering, by gravity, one ball at a time to said base for reception in one of said pockets, and said baseball being rotatable to a second position in which said opening is above the interior of the baseball and free from the ball ejecting mechanism so that individual smaller baseballs may be freely inserted into said interior.

* * * * *